US006997334B2

(12) United States Patent
Manix et al.

(10) Patent No.: US 6,997,334 B2
(45) Date of Patent: Feb. 14, 2006

(54) COMBINED INFLATION NEEDLE AND STORAGE DEVICE

(76) Inventors: Paul D. Manix, 22627 Hatleras St., Woodland Hills, CA (US) 91367; Mary D. Manix, 22627 Hatleras St., Woodland Hills, CA (US) 91367

( * ) Notice: Subject to any disclaimer, the term of this patent is extended or adjusted under 35 U.S.C. 154(b) by 0 days.

(21) Appl. No.: 10/913,554

(22) Filed: Aug. 6, 2004

(65) Prior Publication Data

US 2005/0006328 A1 Jan. 13, 2005

Related U.S. Application Data

(63) Continuation-in-part of application No. 10/154,703, filed on May 24, 2002, now abandoned.

(51) Int. Cl.
*A47F 5/08* (2006.01)

(52) U.S. Cl. ..... 211/89.01; 211/70.6; 211/13.1; 206/380; 206/383

(58) Field of Classification Search ..... 211/70.7, 211/69.5, 69, 70.6, 60.1, 13.1, 86.01, 87.01, 211/89.01; 206/443, 349, 365–367, 380–383, 206/562, 564, 369
See application file for complete search history.

(56) References Cited

U.S. PATENT DOCUMENTS 1,538,849 A * 5/1925 Eger ..... 211/70.6
1,595,121 A * 8/1926 Reiss ..... 206/383
2,412,938 A * 12/1946 Amoth ..... 211/69.5
D155,024 S * 8/1949 Mozneck ..... D6/571
2,971,637 A * 2/1961 Simons ..... 206/369
2,974,804 A * 3/1961 Maro ..... 211/70.6
3,227,265 A * 1/1966 Schneider ..... 206/382
3,248,167 A * 4/1966 Friedman ..... 433/25
3,367,483 A * 2/1968 Studen ..... 206/379
3,468,590 A * 9/1969 Howard ..... 312/73
3,545,606 A * 12/1970 Lightner et al. ..... 206/716
3,796,454 A * 3/1974 Williamson et al. ..... 294/7
4,030,599 A * 6/1977 Bruni ..... 206/379
4,232,784 A * 11/1980 Hesselgren ..... 206/210
4,253,830 A * 3/1981 Kazen et al. ..... 433/77
4,294,365 A * 10/1981 Henderson ..... 211/60.1
4,345,688 A * 8/1982 De Boer ..... 211/70.6
4,397,395 A * 8/1983 McKelvey ..... 211/69
4,415,092 A * 11/1983 Boyer ..... 211/69.1
4,503,972 A * 3/1985 Nelligan et al. ..... 206/379
4,573,574 A * 3/1986 Connery ..... 206/726
4,813,551 A * 3/1989 Kuo ..... 211/70.6
4,871,074 A * 10/1989 Bryson et al. ..... 211/26
5,129,528 A * 7/1992 Eidsmoe et al. ..... 211/70.6
5,188,242 A * 2/1993 Smith ..... 211/69

(Continued)

OTHER PUBLICATIONS

Black&Decker Instruction Manual for Inflator/Compressor, 1992. See Figure 3B.*

*Primary Examiner*—Jennifer E. Novosad
(74) *Attorney, Agent, or Firm*—Lewis Brisbois Bisgaard & Smith LLP; Sanford Astor

(57) ABSTRACT

In combination an inflation needle storage device (10) to keep track of, protect and store inflation needles (14). The inflation needle storage device (10) is made of a resilient material, with a solid base (18) having receiving holes (12) designed so that the stems (17) of inflation needles (14) fit snugly inside of receiving holes (12) and are held in place by friction so that they cannot fall out. The inflation needle storage device (10) has a transverse hole (20) through it, to thread an attachment device, such as a nail, chain, string or wire, to attach the inflation needle storage device (10) to any convenient surface.

12 Claims, 2 Drawing Sheets

U.S. PATENT DOCUMENTS 5,505,316 A * 4/1996 Lee ..... 211/70.6
5,570,794 A * 11/1996 Drower ..... 211/89.01
5,641,079 A * 6/1997 Schmidt ..... 211/70.6
5,678,700 A * 10/1997 Crosson, Jr. ..... 211/70.8
6,053,316 A * 4/2000 Lo ..... 206/379
6,474,482 B1 * 11/2002 Manix et al. ..... 211/70.6

* cited by examiner

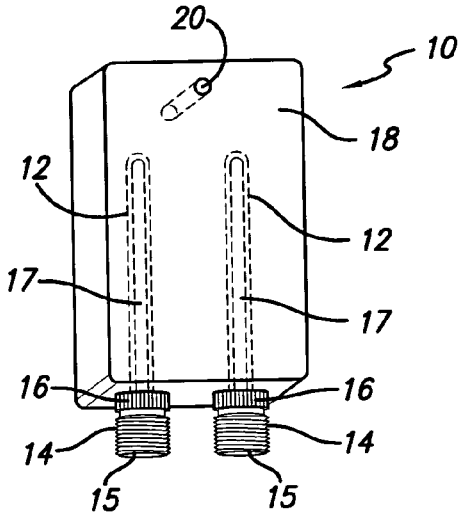
FIG. 1
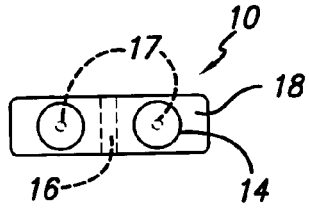
FIG. 2
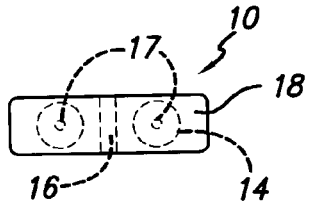
FIG. 3
FIG. 4
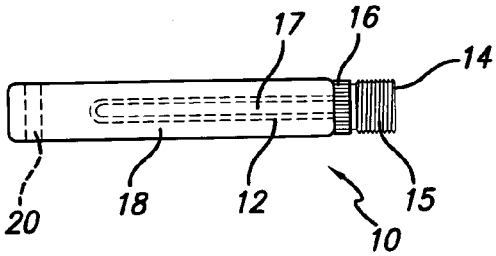
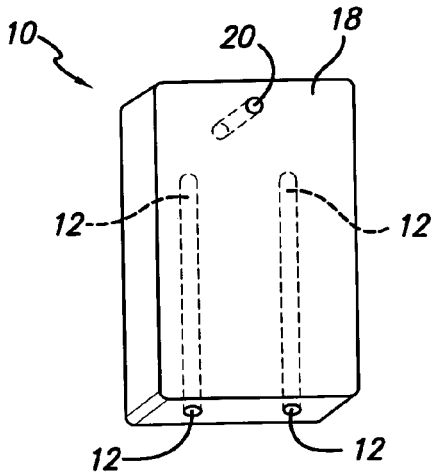
FIG. 5
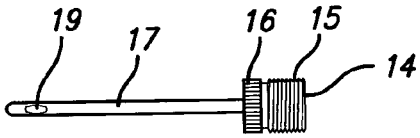
FIG. 6

COMBINED INFLATION NEEDLE AND STORAGE DEVICE

This application is a continuation-in-part of our application Ser. No. 10/154,703, filed May 24, 2002 now abandoned.

BACKGROUND OF THE INVENTION

This invention relates in general to holding devices for inflation needles. More specifically, this invention relates to a portable inflation needle holder, which can be attached to an air pump, key chain, gym bag, backpack or belt loop.

Inflation needles are commonly needed around the home, school and gym for a variety of uses. Some of these uses are for inflation of footballs, basketballs, volleyballs, rugby balls, water polo balls, soccer balls and kick balls. Inflation needles are usually sold three to a package. Once the cardboard and plastic package is opened and the first needle is used, the other two quickly get misplaced. The first needle is often left attached to the pump and gets bent and is rendered useless. Inflation needles usually snap into two pieces when you try to straighten them. The search for an inflation needle usually starts on the way out of the house, when the ball to be used in the game that day is discovered to be flat. After a mad dash through the house searching for those elusive inflation needles, the owner has to make a choice between a quick stop at the sporting goods store or playing with a flat ball.

Storage racks for some articles are also known, such as the racks described in the U.S. Pat. No. 5,570,794 to Drower, or in U.S. Pat. No. 5,678,700 to Crossen, Jr., or U.S. Pat. No. 4,294,365 to Henderson. These racks, however, are not suited to inflation needles, because inflation needles need to be attached to a specific convenient location at the choice of the user, which may be fixed or portable. Inflation needles on the garage wall will not help the sports enthusiast who discovers on the playing field that the game ball needs air. The above patents are rendered useless when portability is needed. The above patents are not suitable to house inflation needles because the needles would fall out if the devices described in the patents were turned upside down. None of the above patent devices are portable and if they were, the objects in them would be lost or damaged in short order because the contents are not held in place by friction. Additionally, inflation needles stems are easily damaged, and none of the above holders would protect the stems by completely encasing them in material.

SUMMARY OF THE INVENTION

The inflation needle storage holder of the present invention comprises one resilient base having one or more evenly spaced round inflation needle receiving holes in said base adapted to frictionally hold one or more inflation needles and protect them from damage. The round receiving holes are slightly smaller in diameter than the inflation needle stems and hold the inflation needles in place tightly enough that they cannot fall out of the base. The inflation needles are accessed by pulling the stems out of their receiving holes and are restored by pushing them back into the receiving holes when finished, similar to the way one uses a knife and sheath.

The resilient base has a transverse hole, which passes completely through the base, through which an attachment device, such as nail, chain, piece of wire or string may be passed, to attach the holder to any convenient surface determined by the user, such as a wall, gym bag, air pump, backpack, locker or a key chain, providing an easy, practical place to store inflation needles so they are easily located when needed.

The inflation needle storage holder is made of a resilient but pliable material, such as rubber, plastic, cork, paper, foam rubber, but not limited to these materials. The inflation needle storage resilient base may be any shape: rectangular, round, square, oval, trapezoidal or oblong.

The receiving holes enter the base longitudinally, but do not go completely through the base, thus surrounding the entire circumference of the needle stems, as well as the end of the stems, protecting them from damage.

OBJECTS OF THE INVENTION

Accordingly, several objects and advantages of the invention are as follows:

An object of the present invention is to provide convenient and reliable accessibility to inflation needles anywhere the user desires: home, school, park or sporting venue.

It is also an object of the present invention to provide such a device, which is of simple, inexpensive construction.

It is also an object of the present invention to provide a storage device that helps prevent damage to inflation needle stems by surrounding them with a resilient material.

A further object is to provide such a device which will greatly reduce loss of time and expense incurred from losing or misplacing inflation needles.

Yet another object of the invention is to provide an inflation needle storage device which can be either permanently affixed to an object or be portable.

BRIEF DESCRIPTION OF THE DRAWINGS

FIG. 1 is a perspective view of the inflation needle storage device of this invention with inflation needles frictionally held in position;

FIG. 2 is a top plan view with two inflation needles held in place;

FIG. 3 is a bottom plan view with two inflation needles held in place;

FIG. 4 is a side view of the inflation needle holding device;

FIG. 5 is a perspective view of the holding device without inflation needles;

FIG. 6 is an inflation needle;

DETAILED DESCRIPTION OF THE INVENTION

Figure 7:
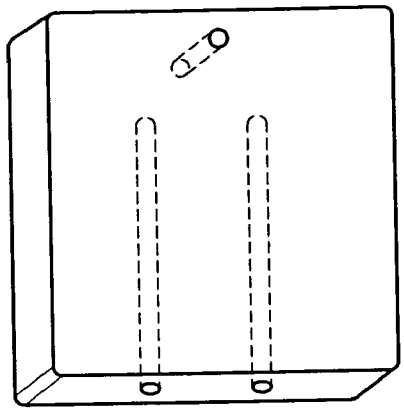
FIG. 7 is a square inflation needle storage device.
Figure 8:
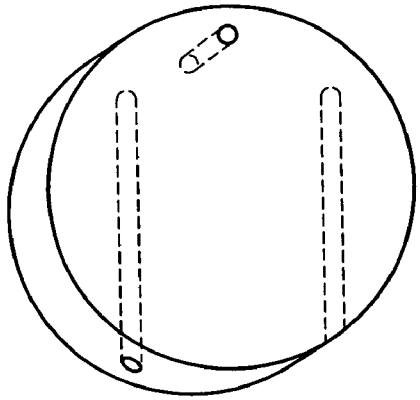
FIG. 8 is a round inflation needle storage device.
Figure 9:
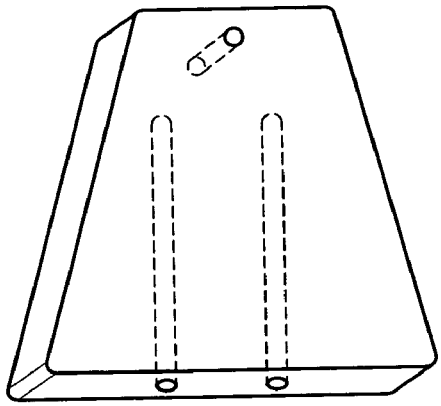
FIG. 9 is a trapezoidal inflation needle storage device.
Figure 10:
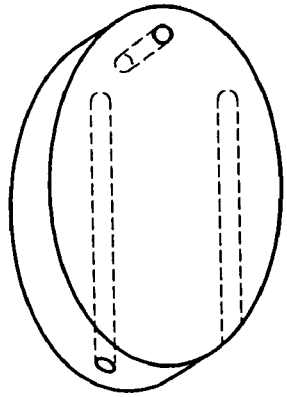
FIG. 10 is a oval inflation needle storage device.

Referring now to the drawings, there is shown in FIGS. 1–6, the inflation needle holder 10 of this invention comprising a solid, pliable but resilient rectangular base 18. Base 18 has from one to a plurality of evenly spaced, round inflation needle receiving holes 12, in the same plane, extending longitudinally into, but not through base 18.

A standard inflation needle 14 is shown in FIG. 6. Inflation needle 14 comprises the threads 15, a notched ring 16 and the shaft or stem 17. A hole 19 is located near the end of stem 17, for the air to exit into the device being filled with air.

The diameter of holes 12 is slightly smaller than the diameter of the stems 17 of inflation needles 14, so that inflation needles 14 are held in place by a constant frictional retaining force surrounding the circumference of stems 17 and cannot fall out of the holder 10 and get lost.

Receiving holes 12 are round and the stems 17 of inflation needles 14 are round. While receiving holes 12 are slightly smaller in diameter than the stems 17, the entire circumference and length of the inflation needle stems 17 are held by frictional force in receiving holes 12. This protects needle stems 17, which are relatively fragile, from damage, such as bending or breaking. Inflation needles 14 must be pushed into the receiving holes 12 and be removed by pulling needles 14 out of receiving holes 12.

Only the stems 17 of inflation needles 14 fit into receiving holes 12 and the needles 14 are stopped by notched ring 16 from going any further into holes 12, thus the threads 15 and the notched ring 16 remain out of and adjacent to receiving holes 12 in base 18 of holder 10. Inflation needles 14 must be grasped by threads 15 and/or notched ring 16 to be pushed into or pulled out of receiving holes 12.

Inflation needle holder 10 has a transverse hole 20 passing completely through base 10 through which a hanging means, such as a nail, chain, wire, or string can be used to attach needle holder 10 to a wall, gym bag, backpack, key ring, air pump, locker or any other location desired by the user.

The inflation needle storage device can be manufactured from any convenient pliant, resilient material, such as ABS (Acrylonitryl-butadyene-styrene), rubber, polyethylene or polypropylene, foam rubber, plastic, cardboard or cork, but not limited to these. While the device shown has two receiving holes to hold inflation needles, the device could have from one to a plurality of inflation needle receiving holes, even ten or more, if desired.

Figure 11:
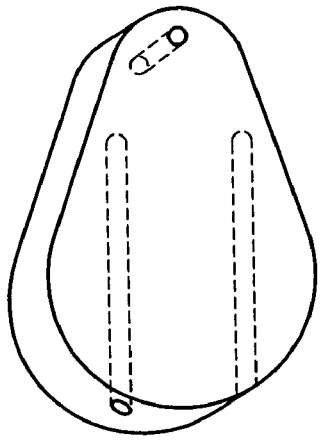
FIG. 11 is an oblong inflation needle storage device.

Referring now to FIGS. 7–11 there is shown other possible shapes for the inflation needle storage device. These include square (FIG. 7); round (FIG. 8); trapezoidal (FIG. 9); oval (FIG. 10); and oblong (FIG. 11).

Having thus described the invention,

We claim:

1. In combination, an inflation needle storage holder and inflation needles having cylindrical stems, comprising a solid resilient base, said base being a solid piece of pliant, resilient material, one or more round receiving holes extending longitudinally into, but not through, said resilient base, said inflation needle stems extending longitudinally into said holes, said holes being slightly smaller in diameter than the inflation needle stems, said holes completely surrounding the entire length and circumference of said stems, creating a retaining force on said inflation needle stems.

2. The holder of claim 1 in which the receiving holes are all in the same plane.

3. The holder of claim 1 further comprising a transverse hole passing completely through the resilient base, and hanging means, passing through said transverse hole to hang the inflation needle holder.

4. The holder of claim 3 in which the hanging means comprises a nail, chain, wire, or string.

5. The holder of claim 1 in which the resilient base is rectangular, round, trapezoidal, square, oval or oblong.

6. The holder of claim 1 in which the holder is made of rubber, plastic, cork, foam rubber, polyethylene or polypropylene.

7. In combination, an inflation needle storage holder and inflation needles, each said inflation needle having threads, a notched ring and a cylindrical stem having a diameter and a circumference, said holder comprising a solid, resilient, pliant base, having one or more round blind receiving holes extending longitudinally into, but not through, said resilient base, said inflation needle stems extending longitudinally into said holes, said holes being slightly smaller in diameter than the inflation needle stems, said holes completely surrounding the entire length of, and circumference of, said stems, adjacent to the notched ring of the inflation needles, creating a retaining force on said inflation needle stems, said retaining force being sufficient to prevent the inflation needles from falling out of said receiving holes.

8. The holder of claim 7 in which the receiving holes are all in the same plane.

9. The holder of claim 7 further comprising a transverse hole passing completely through the resilient base, and hanging means, passing through said transverse hole to hang the inflation needle holder.

10. The holder of claim 9 in which the hanging means comprises a nail, chain, wire, or string.

11. The holder of claim 7 in which the resilient base is rectangular, round, trapezoidal, square, oval or oblong.

12. The holder of claim 7 in which the holder is made of rubber, plastic, cork, foam rubber, polyethylene or polypropylene.

* * * * *